US008622137B2

(12) United States Patent
Childres et al.

(10) Patent No.: US 8,622,137 B2
(45) Date of Patent: Jan. 7, 2014

(54) SUBSEA STRUCTURE INSTALLATION OR REMOVAL

(75) Inventors: William Scott Childres, Cypress, TX (US); John Joseph Kenney, Houston, TX (US); William Michael Pritchett, Houston, TX (US); Bruce Clinton Volkert, Bellaire, TX (US)

(73) Assignee: Shell Oil Company, Houston, TX (US)

( * ) Notice: Subject to any disclaimer, the term of this patent is extended or adjusted under 35 U.S.C. 154(b) by 278 days.

(21) Appl. No.: 13/060,019

(22) PCT Filed: Aug. 13, 2009

(86) PCT No.: PCT/US2009/053700

§ 371 (c)(1),
(2), (4) Date: Apr. 20, 2011

(87) PCT Pub. No.: WO2010/021907

PCT Pub. Date: Feb. 25, 2010

(65) Prior Publication Data

US 2011/0186301 A1 Aug. 4, 2011

Related U.S. Application Data

(60) Provisional application No. 61/090,624, filed on Aug. 21, 2008.

(51) Int. Cl.
*E21B 7/12* (2006.01)

(52) U.S. Cl.
USPC ..... 166/338; 166/351; 166/352; 166/355; 405/158; 405/171

(58) Field of Classification Search
USPC ..... 166/338–340, 351, 352, 355, 381, 85.1; 405/158, 171, 173, 184.4; 441/1, 133
See application file for complete search history.

(56) References Cited

U.S. PATENT DOCUMENTS

| | | | | | |
|---|---|---|---|---|---|
| 3,626,701 | A * | 12/1971 | Laffont | 405/202 |
| 4,277,202 | A * | 7/1981 | Archambaud et al. | 405/169 |
| 4,284,143 | A * | 8/1981 | Scherrer et al. | 166/350 |
| 4,365,576 | A * | 12/1982 | Cook | 405/200 |
| 4,625,805 | A * | 12/1986 | Ladecky | 166/341 |
| 4,702,320 | A * | 10/1987 | Gano et al. | 166/343 |
| 4,762,180 | A * | 8/1988 | Wybro et al. | 166/350 |
| 4,793,737 | A * | 12/1988 | Shotbolt | 405/169 |
| 5,069,580 | A | 12/1991 | Herwig et al. | 405/191 |
| 5,117,914 | A * | 6/1992 | Blandford | 166/344 |
| 5,190,107 | A | 3/1993 | Langner et al. | 166/355 |
| 5,255,744 | A * | 10/1993 | Silva | 166/347 |
| 5,433,273 | A * | 7/1995 | Blandford | 166/344 |
| 5,816,183 | A * | 10/1998 | Braud et al. | 114/230.13 |
| 6,752,100 | B2 * | 6/2004 | Guinn et al. | 114/258 |
| 6,910,831 | B2 * | 6/2005 | Raines | 405/224.1 |
| 6,935,262 | B2 | 8/2005 | Roodenburg et al. | 114/258 |
| 7,150,325 | B2 | 12/2006 | Ireland et al. | 166/366 |
| 7,314,084 | B2 | 1/2008 | Rodrigues et al. | 166/344 |
| 7,452,162 | B2 * | 11/2008 | Wybro et al. | 405/223.1 |
| 7,527,455 | B2 * | 5/2009 | Raines | 405/228 |
| 7,908,988 | B1 * | 3/2011 | Khachaturian | 114/51 |
| 2002/0142683 | A1 * | 10/2002 | Campbell et al. | 441/133 |
| 2003/0044240 | A1 * | 3/2003 | Bergeron | 405/224 |
| 2003/0170077 | A1 | 9/2003 | Herd et al. | 405/224.2 |

(Continued)

*Primary Examiner* — Matthew Buck
*Assistant Examiner* — Aaron Lembo

(57) ABSTRACT

There is disclosed a system comprising a subsea structure; and a carrier comprising an opening adapted to receive the subsea structure.

12 Claims, 14 Drawing Sheets

(56) References Cited

U.S. PATENT DOCUMENTS

| | | | | |
|---|---|---|---|---|
| 2003/0221602 | A1 | 12/2003 | Guinn et al. | 114/258 |
| 2005/0152748 | A1 | 7/2005 | Tangen et al. | 405/209 |
| 2005/0220645 | A1 | 10/2005 | Kerr et al. | 417/555.1 |
| 2006/0118310 | A1 | 6/2006 | Euphemio et al. | 166/368 |
| 2008/0035327 | A1 | 2/2008 | Fowkes | 166/85.5 |
| 2008/0199257 | A1* | 8/2008 | Hilditch et al. | 405/209 |
| 2008/0314598 | A1 | 12/2008 | Rodrigues et al. | 166/342 |
| 2012/0315096 | A1* | 12/2012 | Byers et al. | 405/195.1 |

* cited by examiner

SUBSEA STRUCTURE INSTALLATION OR REMOVAL

PRIORITY CLAIM

The present application claims priority of U.S. Provisional Patent Application No. 61/090,624 filed 21 Aug. 2008.

BACKGROUND OF THE INVENTION

Currently, sub-sea equipment (e.g., submersible pumps, manifolds, and trees) may be deployed and/or retrieved using a semi-submersible drilling rig. Typically, the drilling rigs are configured to hoist the sub-sea equipment from the ocean floor to the surface through the use of cables and lines. Once the sub-sea equipment has reached the surface, it may be lifted through an opening in the center of the rig (e.g., moon pool) and onto the deck of the drilling rig. As such, the piece of sub-sea equipment being retrieved or deployed may be susceptible to being damaged during transportation. Further, drilling rigs are extremely expensive to operate, costing around $600,000-$800,000/day to lease. Furthermore, drilling rigs are transported at a slow rate when compared to other floating vessels (e.g., ships, tug boats), which may increase the amount of time it takes to retrieve and/or deploy sub-sea equipment. Accordingly, there exists a need for an efficient and cost effective system to retrieve and/or deploy sub-sea equipment.

U.S. Patent Application Publication Number 2003/0221602 discloses an alternative for deploying and installing subsea equipment using a workboat or other vessel of opportunity. The equipment is not supported directly by the vessel, but is instead supported by one or more buoys below the wave zone. The buoys are controlled by a combination of chain, wire rope, and synthetic line linking it to the workboat. As such, the buoy system described therein decouples vessel motion from the payload by supporting the payload from the buoys below the wave zone. Because the buoys are below the wave action and its associated turbulence, there is little energy and hence little tendency for motion. The result is a stable, inexpensive, maneuverable system capable of servicing large subsea payloads in a wide range of water depths. U.S. Patent Application Publication Number 2003/0221602 is herein incorporated by reference in its entirety.

U.S. Pat. No. 7,314,084 discloses a system comprising a pumping module coupled to an intermediate flow inlet (IFI) wherein said IFI is coupled to a base structure disposed on the flow line that routes production from one or more oil wells, allowing for the quick and easy installation or recovery of a subsea pumping module by cable from an inexpensive vessel. The disclosure also provides for the hydraulic isolation of the subsea pumping module by means of on-off valves on the IFI whereby the pumping module can be easily installed or removed without causing underwater oil spills. Sealing of the connection is of the metal-metal type. It is also possible to pass a pig through the system for clearing the flow lines. U.S. Pat. No. 7,314,084 is herein incorporated by reference in its entirety.

U.S. Pat. No. 7,150,325 discloses a subsea pumping assembly located on a seafloor for pumping well fluid from subsea wells to the level. The pumping assembly has a tubular outer housing that is at least partially embedded in the seafloor. A tubular primary housing located in the outer housing and has a lower end with a receptacle. An annular space surrounds the primary housing within the outer housing for delivering fluid to a receptacle at the lower end of the primary housing. A capsule is lowered in and retrieved from the primary housing. The capsule sealingly engages the receptacle for receiving well fluid from the annular space. A submersible pump is located inside the capsule. The pump has an intake that receives well fluid and a discharge that discharges the well fluid exterior of this capsule. The capsule has a valve in its inlet that when closed prevents leakage of well fluid from the capsule. The capsule may be retrieved through open sea without a riser. U.S. Pat. No. 7,150,325 is herein incorporated by reference in its entirety.

U.S. Patent Application Publication Number 2005/0220645 discloses a booster pumping system for producing hydrocarbons from a subsea production well. The booster pumping system includes: (1) a submersible pump hydraulically connected to the production well to provide energy to the hydrocarbon flow and boost production to another destination such as a subsea production facility or the surface via a riser; (2) an inlet conduit to receive the flow from the production well and isolate the flow from the dummy wellbore and direct the flow to the intake of the pump; and (3) a motor exposed to the dummy wellbore to drive the pump. The dummy wellbore may be flooded or circulated with seawater to cool the motor. U.S. Patent Application Publication Number 2005/0220645 is herein incorporated by reference in its entirety.

U.S. Patent Application Publication Number 2006/0118310 discloses a subsea production system for producing petroleum by artificial elevation, assisted by submersible centrifugal pumps (SCPs) upstream of the WCT and installed on the seabed, including a pumping module having one of more SCPs, installed in series or in parallel, with an inclination of up to 85 degrees in relation to the vertical, the module being connectable to a flow base to permit the "bypass" of production and wherein the pumping module and the flow base may be linked to installation and recovery by cable. A production line is connected upstream to the pumping module upstream and another production line is connected downstream to the pumping module. A method of installing the system in a new wellhead is described, as well as a method for installing the system in an existing wellhead. The uses of the subsea production system for boosting multiphase flow, injection of water in an injector well and the transfer of oil between two points of collection are also described. U.S. Patent Application Publication Number 2006/0118310 is herein incorporated by reference in its entirety.

U.S. Patent Application Publication Number 2008/0314598 discloses a system for installation of a subsea module of great length by means of a vessel, using a cable for its installation and/or retrieval, and methods applied therein. The system allows transporting the subsea module on the vessel to a location in the sea and descending the subsea module into the sea at a vertical position for installation on the seabed. U.S. Patent Application Publication Number 2008/0314598 is herein incorporated by reference in its entirety.

SUMMARY OF INVENTION

One aspect of the invention provides a system comprising a subsea structure; and a carrier comprising an opening adapted to receive the subsea structure.

Another aspect of the invention provides a method comprising providing a vessel floating on a surface of a body of water; connecting a line from the vessel to a subsea structure; lifting the subsea structure within the body of water; placing the subsea structure within an opening of a carrier; and lifting the carrier to the surface.

Another aspect of the invention provides a method comprising providing a vessel floating on a surface of a body of water; connecting a line from the vessel to a carrier, the carrier comprising an opening with a subsea structure located therein; lowering the carrier and the subsea structure within the body of water; removing the subsea structure from the opening of the carrier; and installing the subsea structure at desired location within the body of water.

DETAILED DESCRIPTION

Figure 1:
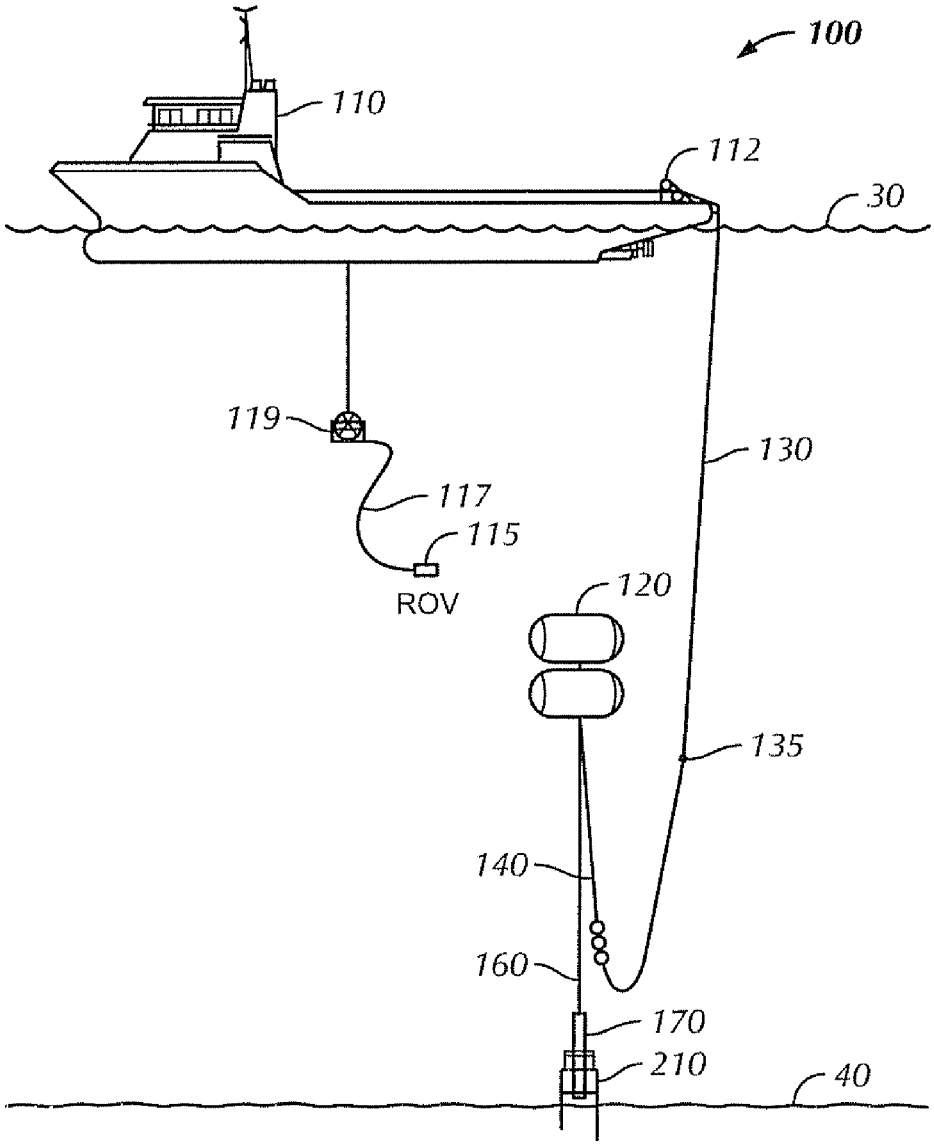
FIGS. 1-5 show a retrieval and deployment system in accordance with embodiments of the present disclosure.
Figure 2:
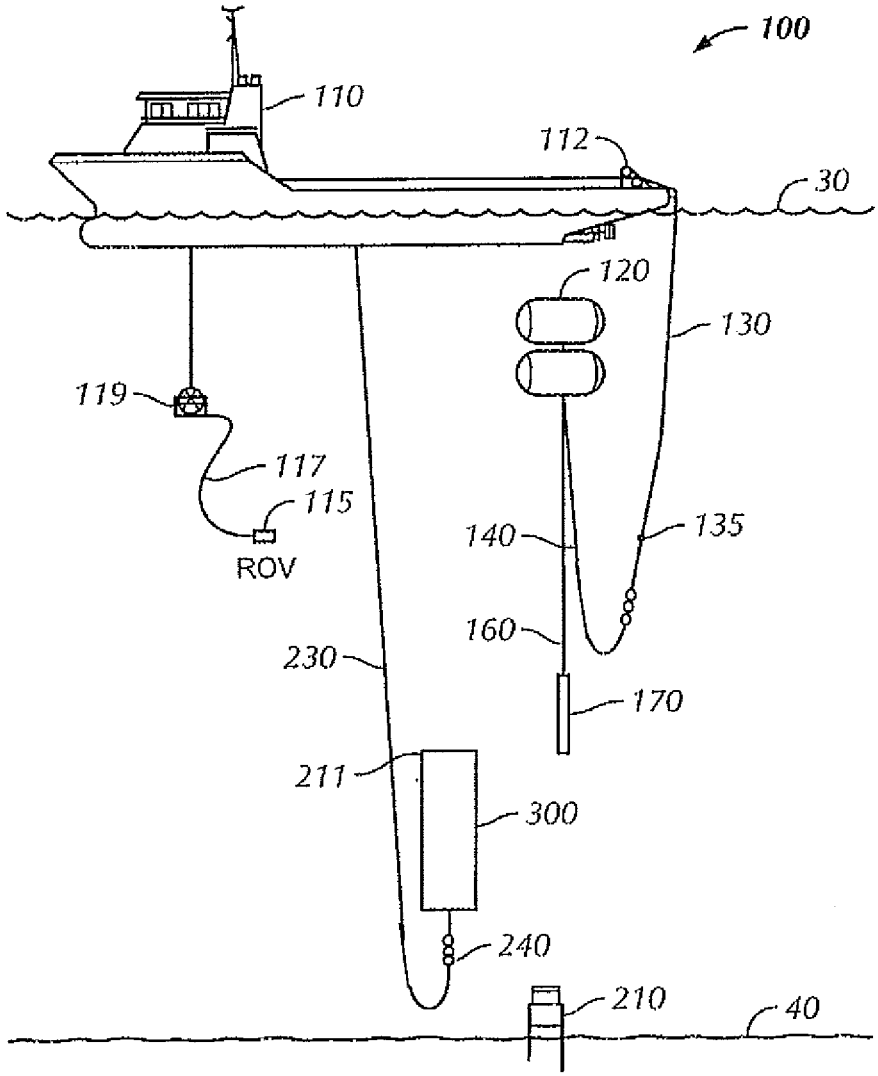
Figure 3:
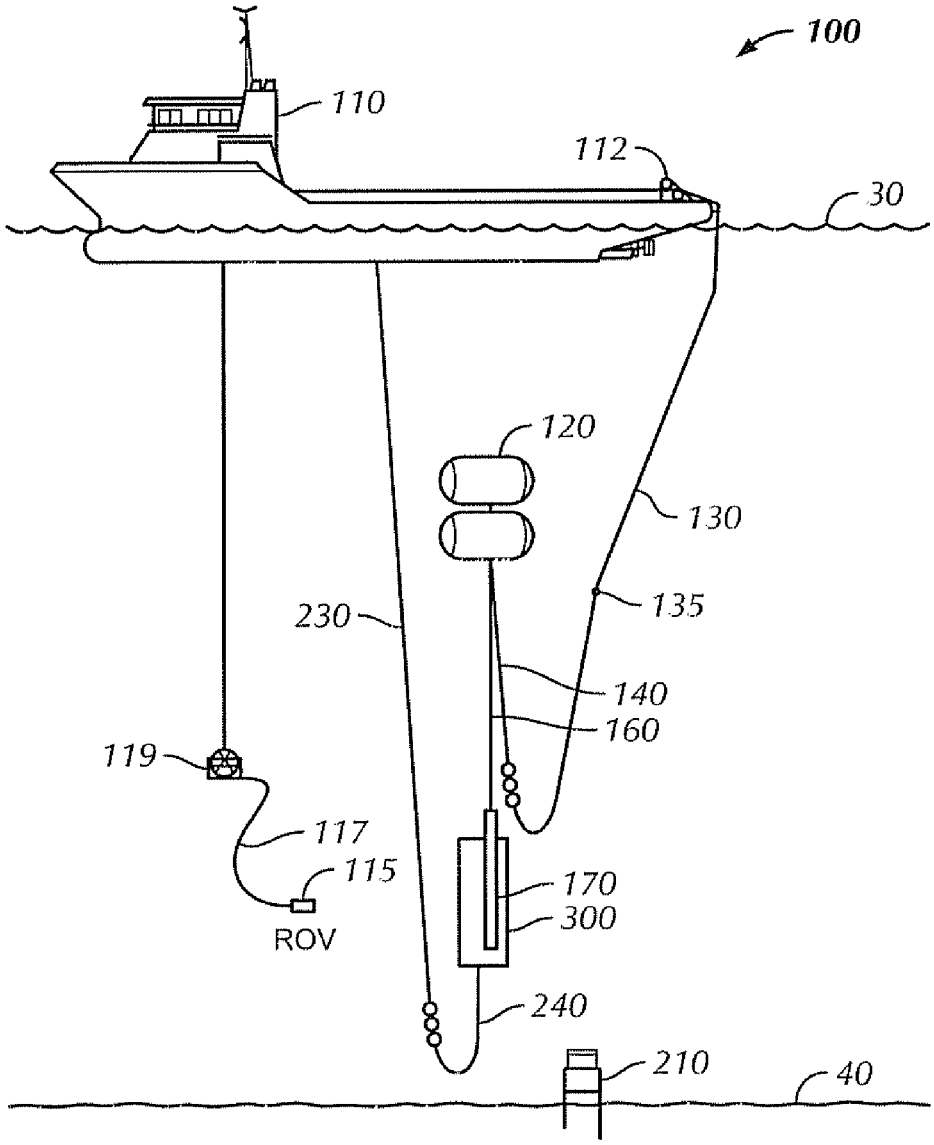
Figure 4:
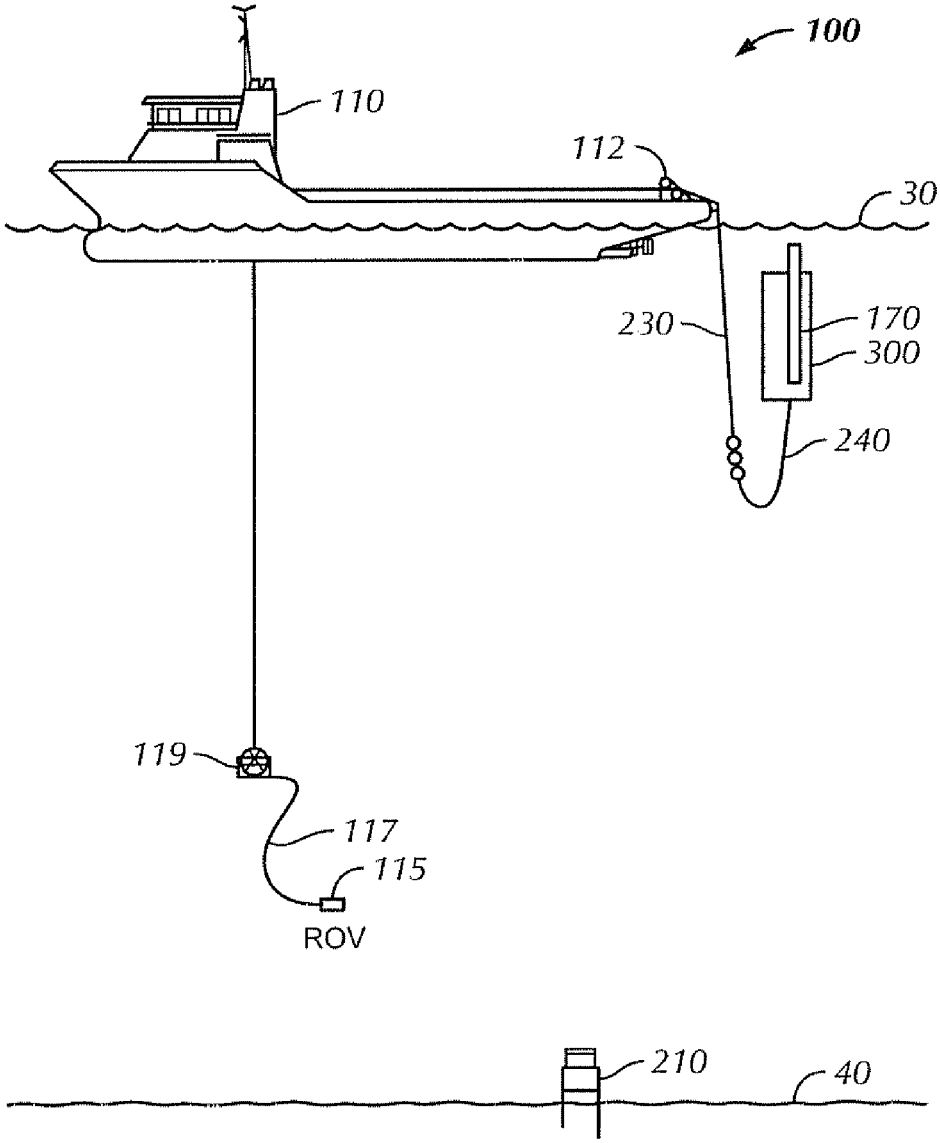
Figure 5:
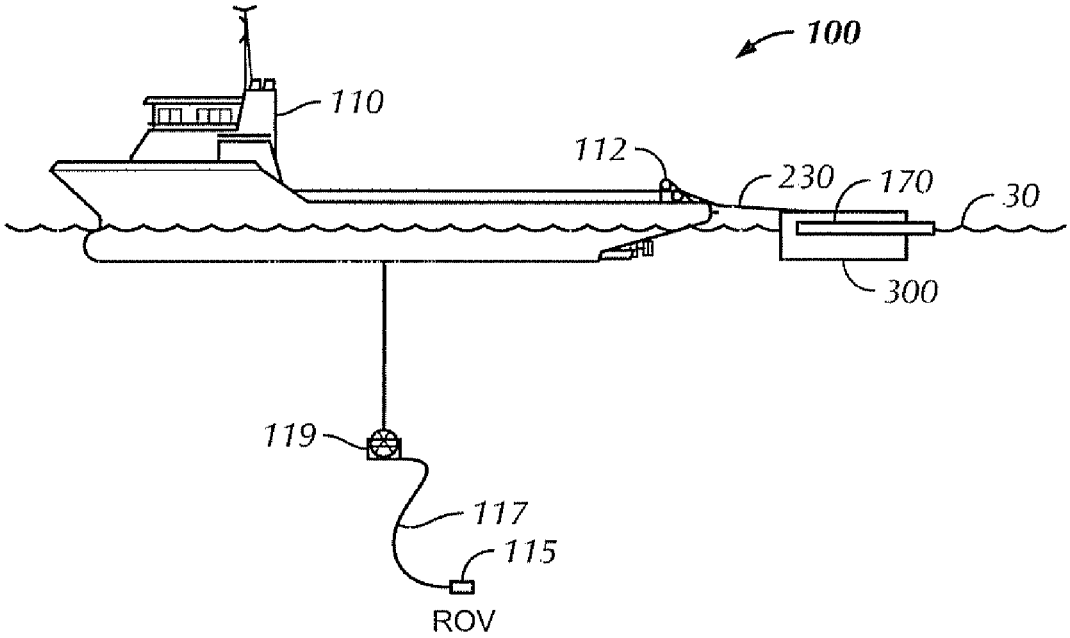
Figure 5:
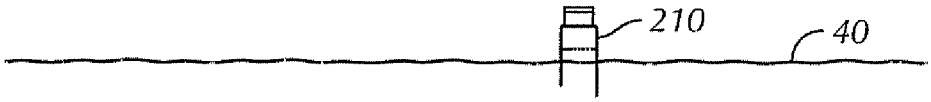

In one aspect, embodiments disclosed herein relate generally to apparatuses and methods for deploying and retrieving sub-sea equipment. Specifically, embodiments disclosed herein relate to a carrier configured to receive, support, and transport sub-sea equipment.

General Overview of Operations

Referring to FIGS. 1-5, a retrieval and deployment system 100 in accordance with embodiments of the present disclosure is shown. During a retrieval operation, a transport vessel 110 deploys buoys 120 that are attached to the transport vessel 110 through a first deployment line 130 and support chain 140. The deployment line 130 may be connected to the support chain 140 by a connector 135. The connector 135 may be a threaded connector, an interference fit connector, a swivel, a hook, or any other connection device known in the art. Further, the support chain 140 may have a "belly" that allows the transport vessel 110 to heave independently of the buoys 120. As such, this may effectively decouple the movement of the buoys 120 from the movement of the transport vessel 110. Further, a system that uses a chain to decouple the movement of a buoy from the movement of a vessel may be referred to as a Heave Compensated and Landing System (HCLS) and is discussed in U.S. Patent Application No. 2003/0221602, which is incorporated herein by reference in its entirety. Furthermore, the weight of the support chain 140 (which may be located under the buoys 120, as shown) may be used to control the depth of the buoys 120.

Once the buoys 120 have been deployed, the buoys 120 are lowered towards the ocean floor 40 to retrieve sub-sea equipment 170. Sub-sea equipment 170 may include, for example, electrical submersible pumps, trees, manifolds, or any other equipment known in the art. The buoys 120 may be raised and lowered using a hoist, crane, winch, or other lifting device known in the art. For example, the buoys 120 may be raised and lowered using a lifting device 112 that is disposed on the transport vessel 110, such as by increasing and decreasing the length of the deployment line 130 and support chain 140 which are connected to the buoys 120. As the buoys 120 reach a depth near the ocean floor 40, a support cable 160, which is coupled to the buoys 120, may be connected to the sub-sea equipment 170. Similar to the connector 135, the support cable 160 may be connected to the sub-sea equipment 170 through the use of a threaded connector, an interference fit connector, a swivel, a hook, or any other connection device known in the art. The connection is typically accomplished using the assistance of a Remotely Operated Vehicle (ROV) 115. After the support cable 160 is attached to the sub-sea equipment 170, the buoys 120 may raise the sub-sea equipment 170 to a specific depth below the surface of the ocean 30.

While the sub-sea equipment 170 is being raised to a specific depth, a carrier 300, such as a rathole, is deployed from the transport vessel 110 (See FIG. 2), or from a secondary transport vessel (not shown). While at an equilibrium state (e.g., before any exterior force is applied) the carrier 300 is configured to float in a horizontal position on the surface of the ocean 30. During operation, a support chain 240 is attached to one end of the carrier 300. The support chain 240 may be coupled to the transport vessel 110 via a deployment line 230. The support chain 240 is positioned and lengthened such that the support chain 240 pulls down on one end of the carrier 300, thereby causing the carrier 300 to rotate to a vertical position. The support chain 240 may be similar to support chain 140, thereby decoupling the movement of the carrier 300 from the movement of the transport vessel 110. Once the carrier 300 is rotated to a vertical position, the carrier 300 is lowered to a depth below the sub-sea equipment 170, which is attached to support cable 160. Following the lowering of the carrier 300 to a depth below the sub-sea equipment 170, the sub-sea equipment 170 is positioned and placed within the carrier 300 (See FIG. 3). For example, using the buoys 120, the first deployment line 130, and the support chain 140, the sub-sea equipment 170 may be lowered into an opening (not shown) within the carrier 300 (See FIG. 3). In such an embodiment, the sub-sea equipment 170 is lowered into the opening to a position that allows the sub-sea equipment 170 to be secured within the carrier 300. After being placed within the carrier 300, the ROV 115 may then be used to engage at least one locking mechanism (not shown), which will secure the sub-sea equipment 170 within the carrier 300. The locking mechanism may include, for example, locking pins, levers, or other locking components known in the art.

Upon securing the sub-sea equipment 170 to the carrier 300, the support cable 160 may be detached from the sub-sea equipment 170 using the ROV 115. After the support cable 160 has been disconnected, the carrier 300 is raised toward the surface of the ocean 30 by drawing in deployment line 230 though the use of the lifting device 112, such as a crane, winch, hoist or other lifting device known in the art (See FIG.

4). As the carrier 300 nears the surface of the ocean 30, the support chain 240 and deployment line 230 may remain connected to the carrier 300. After, the carrier 300 and the sub-sea equipment 170 begin to float near the surface 30, the carrier 300 may return to a nearly horizontal position of equilibrium on the surface of the ocean 30 (See FIG. 5). The transport vessel 110 may then be used to transport the carrier 300 and sub-sea equipment 170 to another location. In one embodiment, the transport vessel 110 may pull the carrier 300 while it is still floating at or near the surface of the ocean water via the deployment line 230. Alternatively, the carrier 300 may be lifted on to the deck of the transport vessel 110 and then transported to another location, or the carrier 300 may be secured to the side of the transport vessel 110 for transportation.

In an alternative embodiment, vessel 110 may be used to first lower carrier 300 into the body of water by lowering line 230, and allowing chain 240 to rest on the ocean floor 40, then disconnecting line 230 from lifting device 112. After carrier 300 has been installed at a desired location in the body of water, equipment 170 may be retrieved with line 160 as described above and connected to carrier 300. Then line 160 may be disconnected from equipment 170, and line 230 retrieved and reconnected to lifting device 112, to transport carrier 300 with equipment 170 inside.

Figure 6:
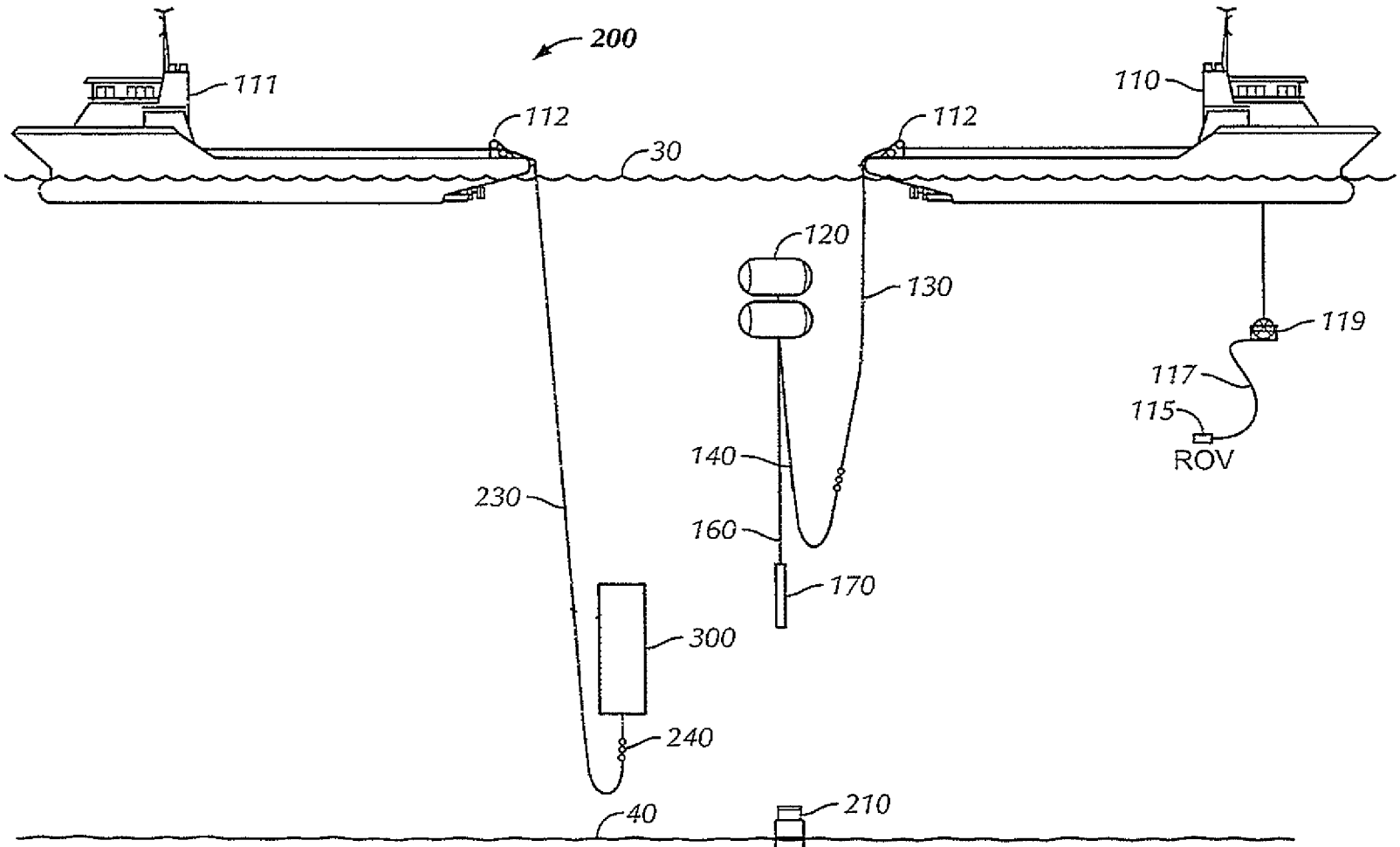
FIGS. 6-8 show another retrieval and deployment system in accordance with embodiments of the present disclosure.
Figure 7:
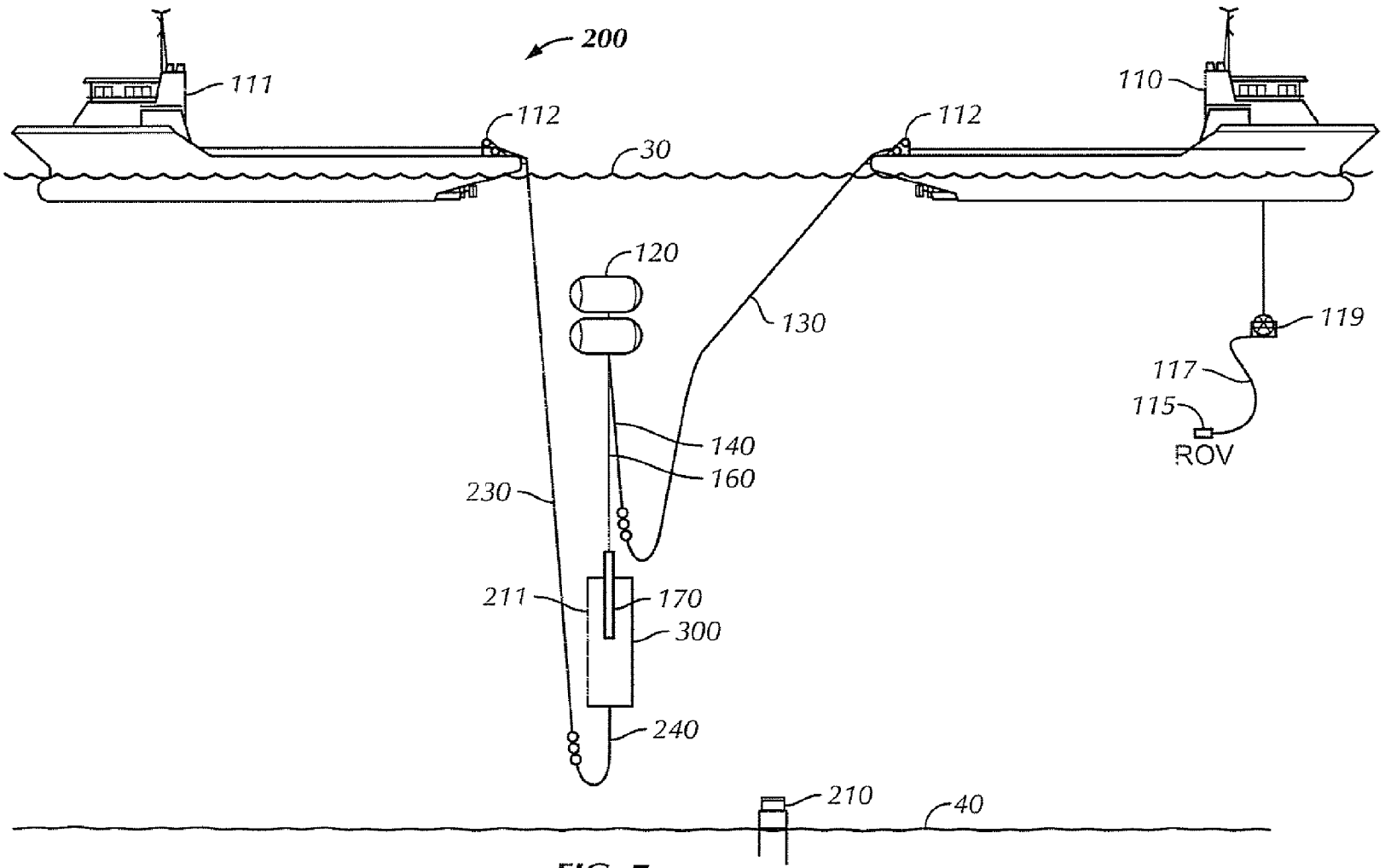
Figure 8:
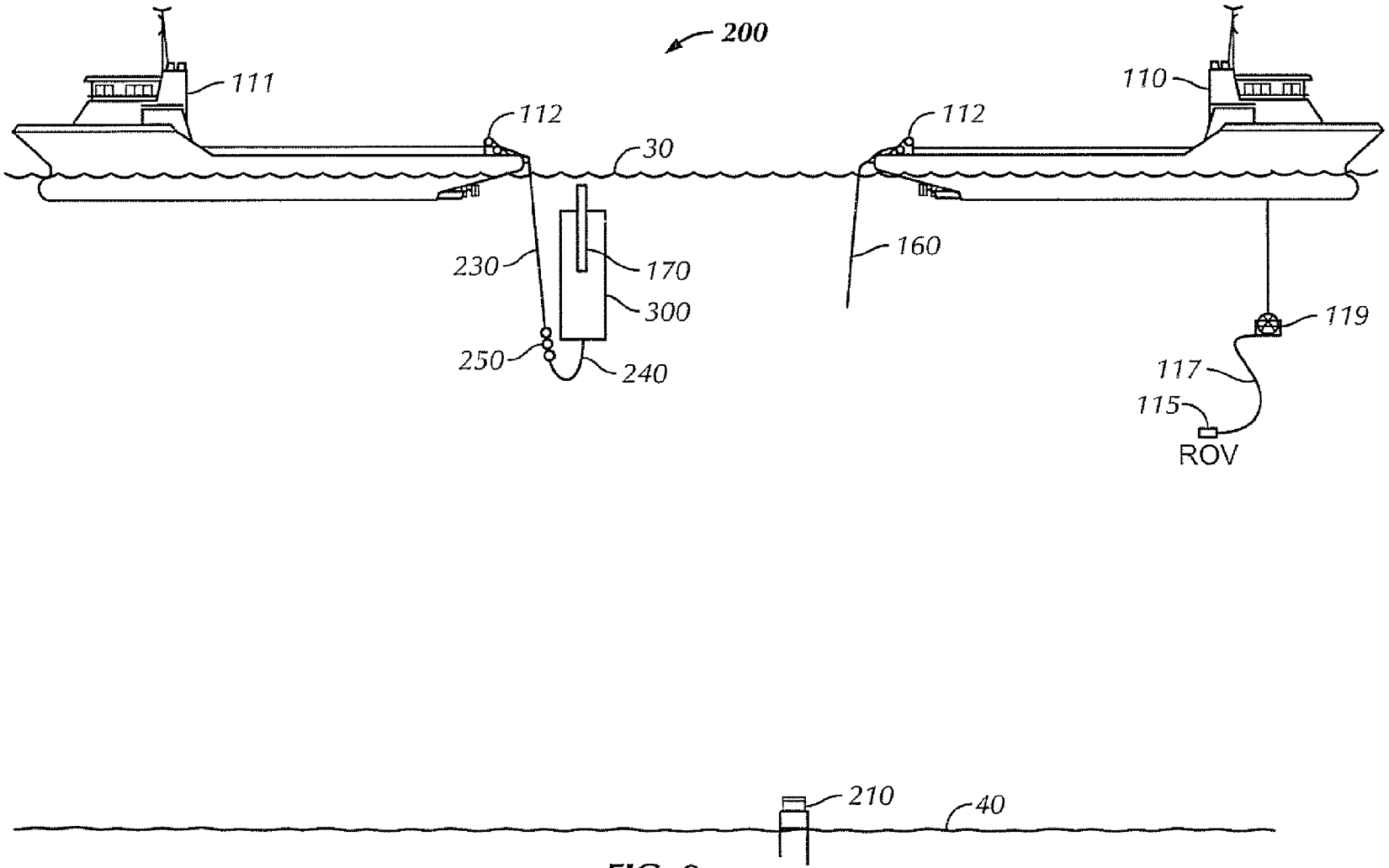

Referring now to FIGS. 6-8, a retrieval and deployment system 200 in accordance with embodiments disclosed herein is shown. In this embodiment, two transport vessels 110, 111 are used, as compared to the system 100 shown in FIGS. 1-5. Similar to the above embodiment, the transport vessel 110 deploys buoys 120 that are attached to the transport vessel 110 through the deployment line 130 and support chain 140. After deployment, the buoys are lowered towards the ocean floor 40 to retrieve the sub-sea equipment 170. The buoys may be raised and lowered using the lifting device 112 that is disposed on the transport vessel 110, such as by increasing and decreasing the length of the deployment line 130 and support chain 140 which are connected to the buoys 120. Further, the weight and/or length of the support chain 140 may be used to control the depth of the buoys 120. As the buoys 120 reach a depth near the ocean floor 40, the support cable 160 coupled to the buoys 120 connects to the sub-sea equipment 170. The connection may be accomplished using the assistance of the ROV 115. After the support cable 160 is attached to the sub-sea equipment 170, the buoys 120 may raise the sub-sea equipment 170 to a specific depth below the surface of the ocean 30.

While the sub-sea equipment 170 is being raised to a specific depth, the carrier 300 may be deployed from a second transport vessel 111. During deployment and operation, a support chain 240 is attached to one end of the carrier 300, in which the support chain 240 may be coupled to the transport vessel 111 via the deployment line 230. The support chain 240 is positioned and lengthened such that the support chain 240 pulls down on one end of the carrier 300. Similar to the above embodiment, the carrier 300 is lowered to a depth below the sub-sea equipment 170. If necessary, the support chain 240 may be allowed to slacken and/or placed on the ocean floor 40 to isolate the carrier 300 from heave of the second transport vessel 111. Following the lowering of the carrier 300 to a depth below the sub-sea equipment 170, the sub-sea equipment 170 is positioned and placed within the carrier 300. After being placed within the carrier 300, the ROV 115 may then be used to engage at least one locking mechanism to secure the sub-sea equipment 170 to the carrier 300. As shown, ROV 115 is shown connected to vessel 110, but alternatively could be connected to vessel 111 or a third vessel (not shown).

After equipment 170 has been connected to carrier 300, support cable 160 may then be detached from the sub-sea equipment 170 using the ROV 115. After the support cable 160 has been disconnected, the carrier 300 is raised toward the surface of the ocean 30 by drawing in deployment line 230 though the use of the lifting device 112 on vessel 111. As the carrier 300 nears the surface of the ocean 30, the support chain 240 and deployment line 230 may remain connected to the carrier 300. In this embodiment, the second transport vessel 111 may pull the carrier 300 while it is still floating near the surface 30 of the ocean water via the deployment line 230. Alternatively, the carrier 300 may be lifted on to the deck of the second transport vessel 111 and then transported to another location, or the carrier 300 may be secured to the side of the second transport vessel 111 for transportation.

A method similar to those described above may be used to deploy sub-sea equipment 170. During the deployment operation, the sub-sea equipment 170 is attached to the carrier 300 while at the surface of the ocean 30. Similar to above, the sub-sea equipment 170 may be attached to the carrier 300 through the use of a locking mechanism. Once the sub-sea equipment 170 is connected to the carrier 300, the carrier 300 is deployed and lowered towards the ocean floor 40 via the support chain 240 and deployment line 230. While the carrier 300 is being lowered, the buoys 120 may be deployed and lowered to a depth above the carrier 300. The support cable 160 is then connected to the sub-sea equipment 170. After the support cable 160 is attached to the sub-sea equipment 170, the locking mechanism is deactivated. Both the connection of the support cable 160 and the deactivation of the locking mechanism may be accomplished using the assistance of the ROV 115. The sub-sea equipment 170 may then be removed from the carrier 300, such as by raising the buoys 120 until the sub-sea equipment 170 has been completely removed from within the carrier 300. Finally, the buoys 120 may transfer the sub-sea equipment 170 to a well head 210 or other desired location near the ocean floor 40.

System Components

As shown in FIGS. 6-8, the transport vessels 110, 111 are configured to transport, retrieve, and/or deploy sub-sea equipment. In one embodiment, the transport vessels 110, 111 include lifting devices 112 that are used to control the length of the deployment lines 130, 230 released from the transport vessels 110, 111. Accordingly, the lifting devices 112 may be used to control the depth of the buoys 120 and/or carrier 300. One skilled in the art will appreciate that the lifting devices 112 may include winches, cranes, or other lifting devices known in the art. In certain embodiments, such as shown in FIGS. 1-5, a single transport vessel 110 may be used to transport, retrieve, and/or deploy the sub-sea equipment 170. In other embodiments, such as shown in FIGS. 6-8, more than one transport vessel, such as two transport vessels 110, 111, may be used to transport, retrieve, and/or deploy the sub-sea equipment 170. The transport vessels 110, 111 may include work boats, tug boats, ships, or other transport vessels known in the art.

The ROV 115, which may swim on an umbilical 117 from a cage 119, may be used to monitor and/or assist with launching, lowering, releasing, and/or locking of the sub-sea equipment 170. Additionally, the ROV 115 may provide visual feedback to the operators while maneuvering equipment during deployment and retrieval operations.

The buoys 120 are configured to transfer the sub-sea equipment 170 and are typically made of sealed vessels, synthetic foam, or syntactic foam, or other buoyant materials known in the art. As such, the buoys 120 are capable of applying a buoyancy force on the sub-sea equipment 170 while submerged within the ocean water. As used herein, buoyancy force is the upward force on an object produced by the surrounding fluid (i.e., ocean water). The buoyancy force of the buoys 120 may move the sub-sea equipment 170 upwards and downwards during deployment and retrieval operations. Further, the buoys 120 are attached to the support chain 140 and the support cable 160. In certain embodiments, the buoys are attached to the support chain 140 and support cable 160 through swivels, hooks, or other attachment methods known in the art.

The support chain 140 couples the buoys 120 to the deployment line 130. The support chain 240 couples the carrier 300 to the deployment line 230. Further, as stated above, the support chains 140, 240 allow the transport vessels 110, 111 to move vertically, relatively independently of the buoys 120 and the carrier 300. As a result, the transport vessels 110, 111 may heave up and down with minimal corresponding movement of the buoys 120 and/or the carrier 300. The weight of the support chains 140, 240 should be sufficient to counteract most of the buoyancy force of the buoys 120 and the carrier 300, thereby allowing the depth of the buoys 120 and carrier 300 to be adjusted. Selecting the support chain size and weight requires establishing a balance between optimizing the "belly," the portion of chain containing "slack" of the support chain 140, 240, and de-coupling the buoys 120 and/or carrier 300 from the transport vessels 110, 111. One skilled in the art will appreciate that the size of the support chain should facilitate a reasonable "belly" length and be fairly easy to handle. Alternatively, a portion of support chains 140 and/or 240 may be laid on the ocean floor 40 to isolate vessel 110, 111 movement from movement of buoys 120 and/or carrier 300.

The deployment line 130 and the deployment line 230 are configured to couple the support chain 140 to the transport vessel 110 and the support chain 240 to the transport vessel 111, respectively. The deployment lines 130, 230 are typically steel cables. However, in certain embodiments, the deployment lines 130, 230 may include chains, wires, ropes or any other deployment device known in the art.

Further, the deployment lines 130, 230 may be configured to couple the transport vessels 110, 111 to the carrier 300 during operation. In one embodiment, the deployment line 230 may be connected to an end of the carrier 300 and be configured to raise and lower the sub-sea equipment 170, in addition to assist in stabilizing the carrier 300 during operation. In other embodiments, the deployment line 230 may be coupled to other locations on the carrier 300, such as, the middle section. Additionally, in certain embodiments, the deployment line 230 may have sufficient strength to allow the transport vessels 110, 111 to pull the carrier 300 to another location of deployment and/or retrieval.

The support cable 160 is configured to couple the buoys 120 to the sub-sea equipment 170. The support cable 160 has sufficient strength to support the weight of the sub-sea equipment 170, which allows the buoys 120 to transfer the sub-sea equipment 170 to various depths during operation. Similar to the deployment lines 130, 230, the support cable 160 may include ropes, chains, wires, or any other support device known in the art.

Further, as shown, clump weights, or other similar weighting devices, may be used to increase the weight of the support chains 140, 240. For example, by attaching one or more clump weights to the support chain 140, the support chain 140 may increase in weight without having to increase the size or length of the support chain. Those having ordinary skill in the art will appreciate that the clump weights may be used with other components of the present disclosure, such as with the buoys and/or support cables, without departing from the scope of the present disclosure.

Figure 9:
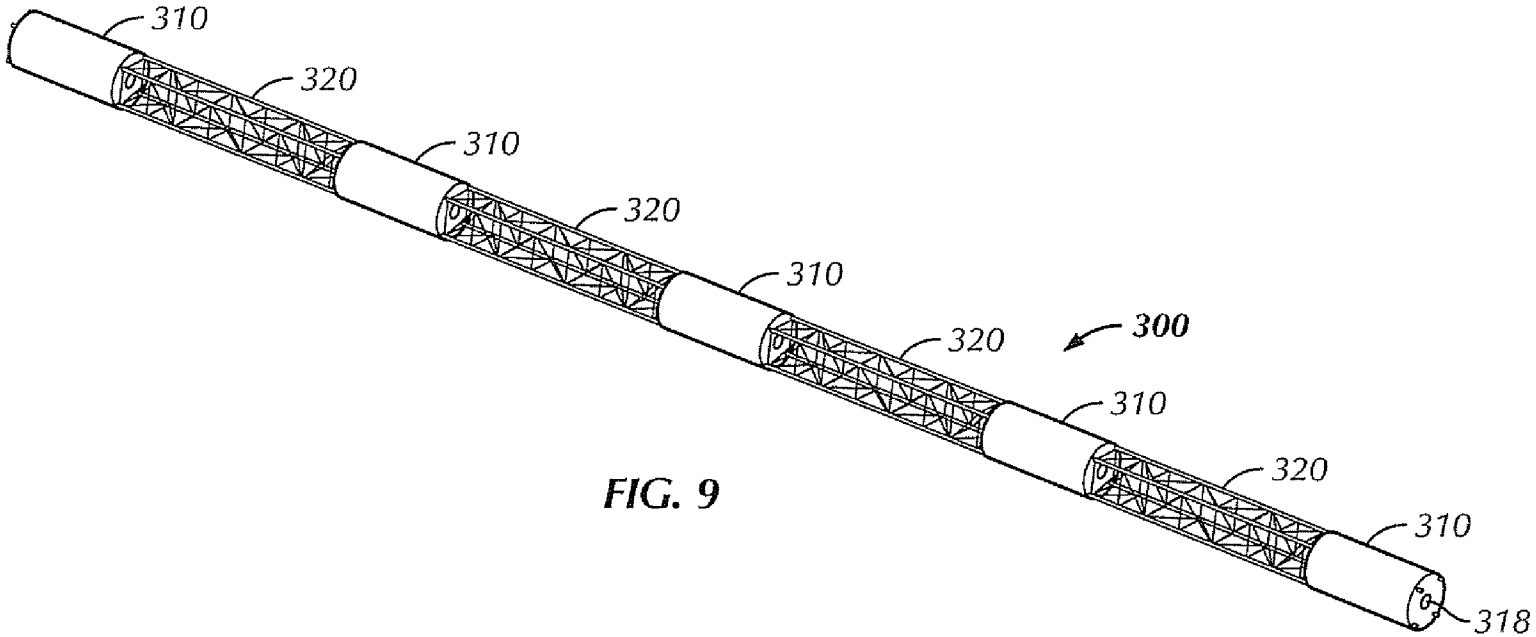
FIG. 9 shows a carrier in accordance with embodiments of the present disclosure.
Figure 10B:
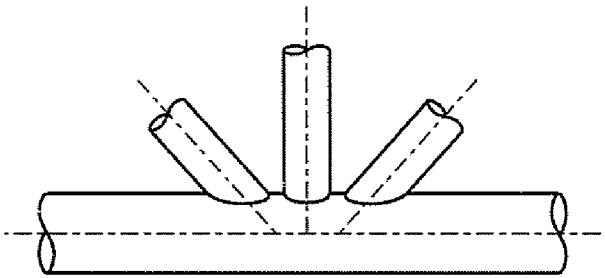
FIG. 10B shows a detail view of a structural frame in accordance with embodiments of the present disclosure.
Figure 10A:
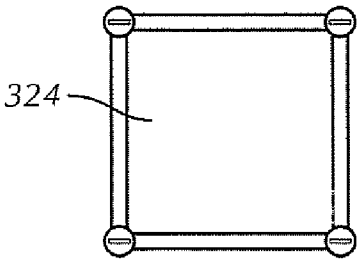
FIG. 10A shows a top view of a structural frame in accordance with embodiments of the present disclosure.
Figure 10C:
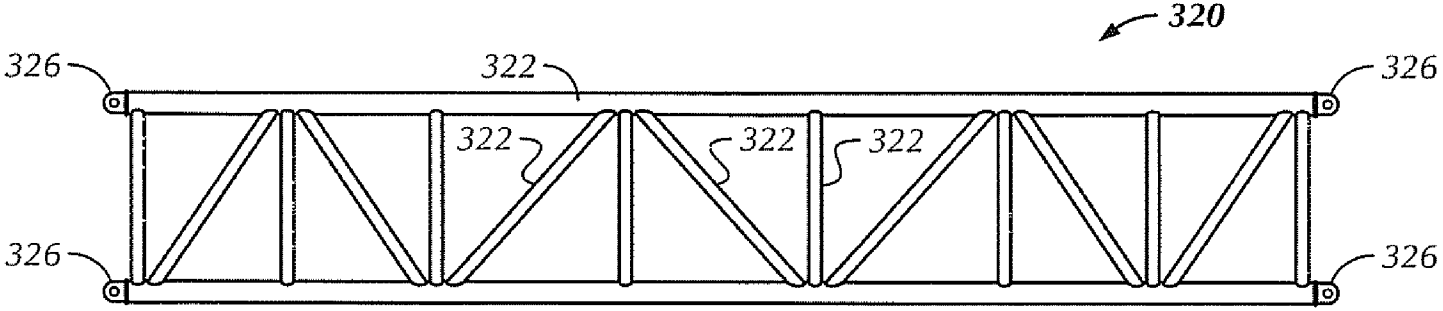
FIG. 10C shows a side view of a structural frame section in accordance with embodiments of the present disclosure.

Referring now to FIG. 9, the carrier 300 in accordance with embodiments of the present disclosure is shown. The carrier 300 includes floatation devices 310 and structural frames 320 that are coupled together. In this embodiment, both the structural frames 320 and the floatation devices 310 include an opening or axial bore 318 therethrough that allows the sub-sea equipment 170 to be received and released from the carrier 300. The floatation devices 310 provide the required buoyancy force to move the carrier 300 along with the sub-sea equipment 170 during the retrieval and deployment operations, in addition to providing structural continuity for the carrier 300. The structural frames 320 provide a structure to which the sub-sea equipment 170 is secured. In addition, the structural frames 320 and the floatation devices 310 may offer protection to the sub-sea equipment 170 while being deployed, retrieved, and/or transported.

Referring now to FIGS. 9 and 10A-10C, in certain embodiments, the structural frame 320 includes support members 322. The support members 322 are positioned such that they form a truss, thereby increasing the structural integrity and reducing the weight of the structural frame 320 (see FIGS. 10B and 10C). Further, the support members 322 form an opening 324 within the support frame 320, which allows the sub-sea equipment 170 to be received by the carrier 300 (see FIG. 10A). One of ordinary skill in the art will appreciate that the opening 324 may vary in size depending upon the type of sub-sea equipment 170 being handled by the carrier 300. Further, one of ordinary skill in the art will appreciate that the structural frame 320 may be buoyant, partially buoyant, or non-buoyant.

Figure 11A:
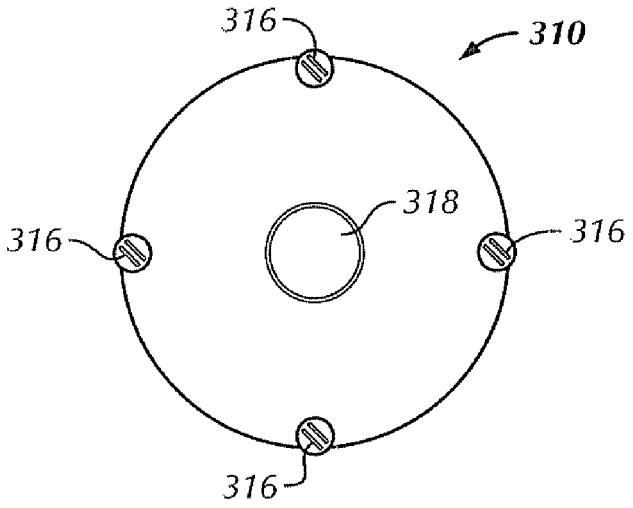
FIG. 11A shows a top view of an open center floatation device or buoyancy module in accordance with embodiments of the present disclosure.
Figure 11B:
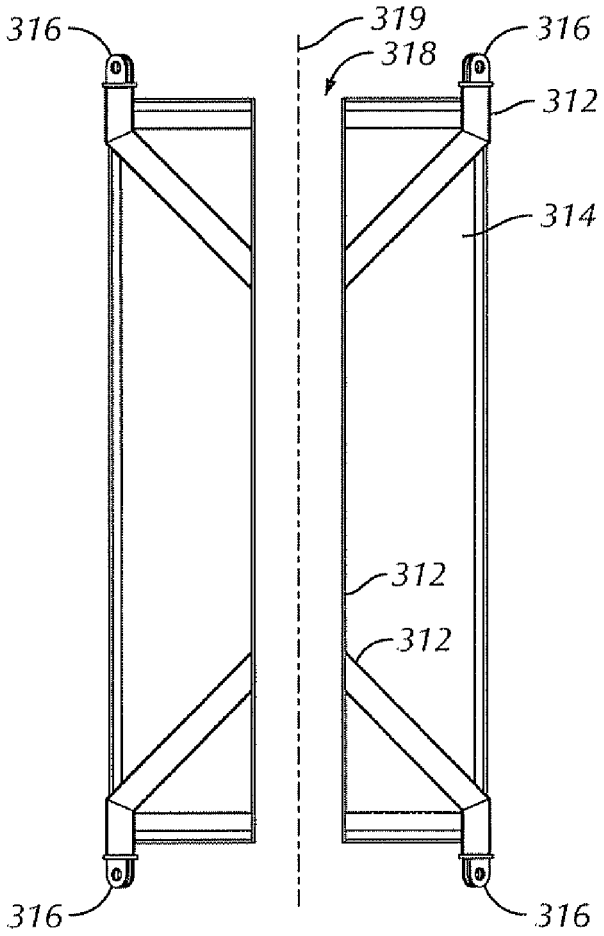
FIG. 11B shows a cross-sectional view of an open center floatation device or buoyancy module in accordance with embodiments of the present disclosure.
Figure 11D:
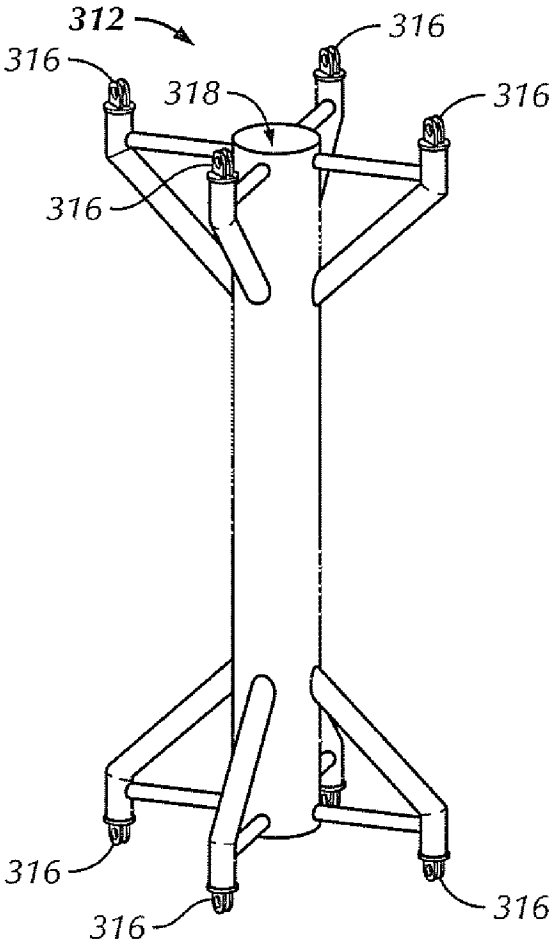
FIG. 11D shows a perspective view of an open center floatation device or buoyancy module structure support frame in accordance with embodiments of the present disclosure.
Figure 11C:
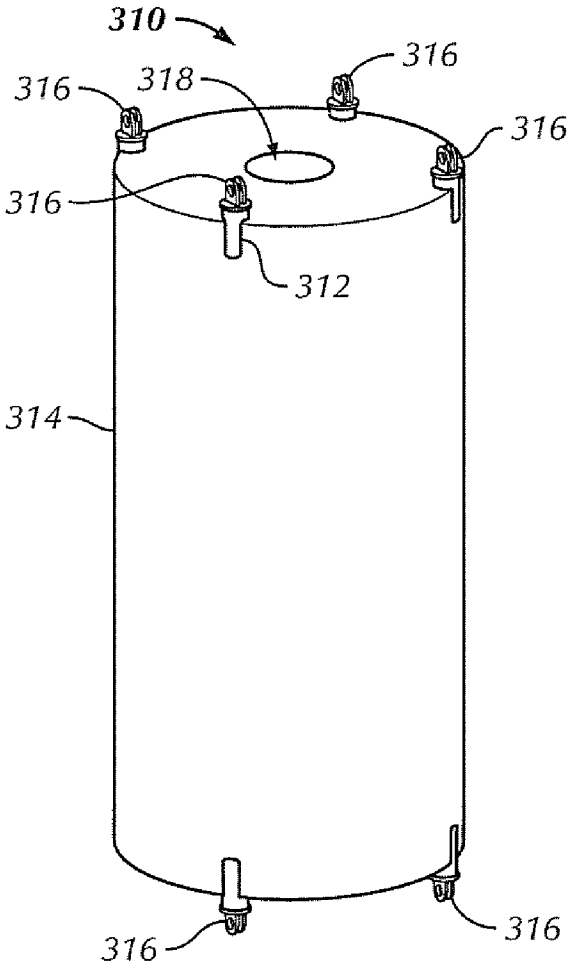
FIG. 11C shows a perspective view of an open center floatation device or buoyancy module in accordance with embodiments of the present disclosure.

Additionally, in certain embodiments, the carrier 300 is modular. For example, the structural frame 320 may include connections 326 that allow the structural frame 320 to be connected and disconnected from the floatation device 310 and/or other structural frame 320 sections, such as with end connections 316 shown in FIG. 11B (discussed in more detail below). The connections 326 may include bolts, nuts, latches or any other connection device known in the art, that allow the structural frame 320 to be connected and disconnected from the floatation device 310, thereby enabling the carrier 300 to be modular. One skilled in the art will appreciate that the modularity of the carrier 300 may make the carrier 300 easier to transport, both on land and at sea, and capable of being assembled at the location of retrieval and/or deployment. Furthermore, the connections 326 may allow additional structural frames 320 and/or additional floatation devices 310 to be connected to the carrier 300, such as to make a longer or shorter carrier 300, depending on the length and/or weight of the sub-sea equipment 170. By allowing additional structural frames 320 and floatation devices 310 to be connected to the carrier 300, the carrier 300 may be configured in various shapes and sizes, which may permit the carrier 300 to receive various types and sizes of sub-sea equipment 170. One skilled in the art will appreciate that there are no physical limitations to this carrier 300, as the carrier 300 could be any suitable length, diameter, strength, and/or weight.

Referring now to FIGS. 9 and 11A-11D, in certain embodiments, the floatation device 310 may include a support structure 312 and a buoyant material 314. The support structure 312 is configured to allow the floatation device 310 to receive and release the sub-sea equipment 170. Further, the support structure 312 enables the floatation device 310 to be coupled to the structural frame 320 and/or other floatation devices 310 while providing structural integrity to the carrier 300. The buoyant material 314 is coupled to the support structure 312 and configured to provide the floatation device 310 with a buoyancy force. The buoyancy force may be translated to the structural frames 320 and other floatation devices 310 through the support structure 312, thereby providing the carrier 300 with the buoyancy force.

In one embodiment, the support structure 312 may include connections 316. Similar to and/or mateable with connections 326, the connections 316 allow the disconnection and connection of the structural frames 320 and/or floatation devices 310 from the carrier 300. Further, in another embodiment, the support structure 312 may include an opening 318 proximate a central axis 319 of the floatation device 310. The opening 318 may be configured to allow the sub-sea equipment 170 to pass through the floatation device 310, which enables the carrier 300 to receive and release sub-sea equipment 170. Further, a structure may define the opening 318, such as a pipe, in which the pipe and the floatation devices 310 may also provide structural support to the sub-sea equipment 170 when disposed within the carrier 300. One skilled in the art will appreciate that the floatation device 310 may include pontoons, buoys, or any other floatation device known in the art.

Moreover, the carrier 300 may include at least one locking mechanism (not shown) configured to secure the sub-sea equipment 170 to the carrier 300. In one embodiment, at least one locking mechanism may be disposed upon at least one structural frame 320 of the carrier 300. In another embodiment, at least one locking mechanism may be disposed on at least one floatation device 310 of the carrier 300. Further, in certain embodiments, at least one locking mechanism may be disposed in a position on the carrier 300 or connected to the carrier 300 that is accessible to the ROV 115, thereby allowing the ROV 115 to activate and/or deactivate the at least one locking mechanism. One skilled in the art will appreciate that the locking mechanism may include locking pins, locking magnets, electronic locks, straps, ropes, a ratchet, tie downs, and/or any other locking devices known in the art.

Figure 12B:
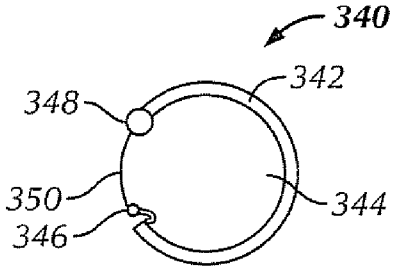
FIG. 12B shows a detail view of a structural frame in accordance with embodiments of the present disclosure.
Figure 12A:
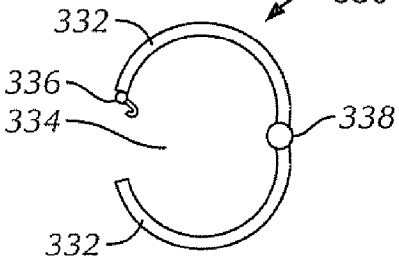
FIG. 12A shows a top view of a structural frame in accordance with embodiments of the present disclosure.

Referring now to FIGS. 12A and 12B, top views of structural frame 330 and structural frame 340 in accordance with embodiments of the present disclosure are shown, respectively. In these embodiments, rather than receiving the sub-sea equipment 170 through an end of the carrier 300, the structural frames 330, 340 (and corresponding floatation devices) may receive the sub-sea equipment through the side of the structural frames 330, 340.

Referring now to FIG. 12A, in certain embodiments, the structural frame 330 may include support members 332. The support members 332 may be connected to each other using a hinge 338 such that the support members 332 may rotate with respect to each other. One skilled in the art will appreciate that the structural frame 330 may include two or more support members 332, in which the support members 332 may be connected using one or more hinges 338. Further, the support members 332 form an opening 334 within the structural frame 330. The sub-sea equipment 170 may then be disposed through a side of the structural frame 330 to be received within the opening 334. The structural frame 330 may include one or more connections 336 that allow the support members 332 of the structural frame 330 to connect and disconnect from each other. The connections 336 may allow the structural frame 330 to open and close to receive and enclose sub-sea equipment 170 therein. Furthermore, similar to the structural frame 320, the structural frame 330 may couple to a floatation device (not shown). This floatation device may have a similar structure to that of the structural frame 330, in which the floatation device may open and close similarly to the structural frame 330 to receive the sub-sea equipment 170 therein.

Referring now to FIG. 12B, in certain embodiments, the structural frame 340 may include one or more support members 342. In this embodiment, the structural frame 340 includes only one support member 342. However, multiple smaller support members 342 may be connected together to form substantially one larger support member 342. The one or more support members 342 form an opening 344, in which the sub-sea equipment 170 may be disposed through a side of the structural frame 340. The structural frame 340 further includes a hinge 348 to connect a latch 350 to the support member 342. Through the use of the hinge 348, the latch 350 may rotate with respect to the support member 342. Further, the latch 350 may include one or more connections 346 that allow the latch 350 to connect and disconnect from the support member 342. Thus, the connections 346 may allow the structural frame 340 to open and close to receive and enclose sub-sea equipment 170 therein. Furthermore, similar to above, the structural frame 340 may couple to a floatation device (not shown), in which this floatation device may have a similar structure to that of the structural frame 340. The floatation device may open and close similarly to the structural frame 340 to receive the sub-sea equipment 170 therein.

Figure 13A:
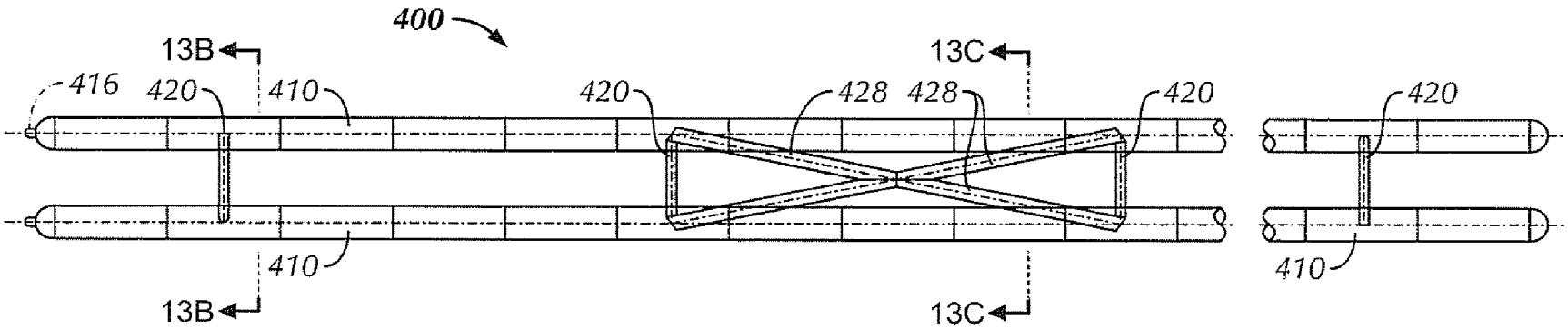
FIG. 13A shows a carrier in accordance with embodiments of the present disclosure.
Figure 13B:
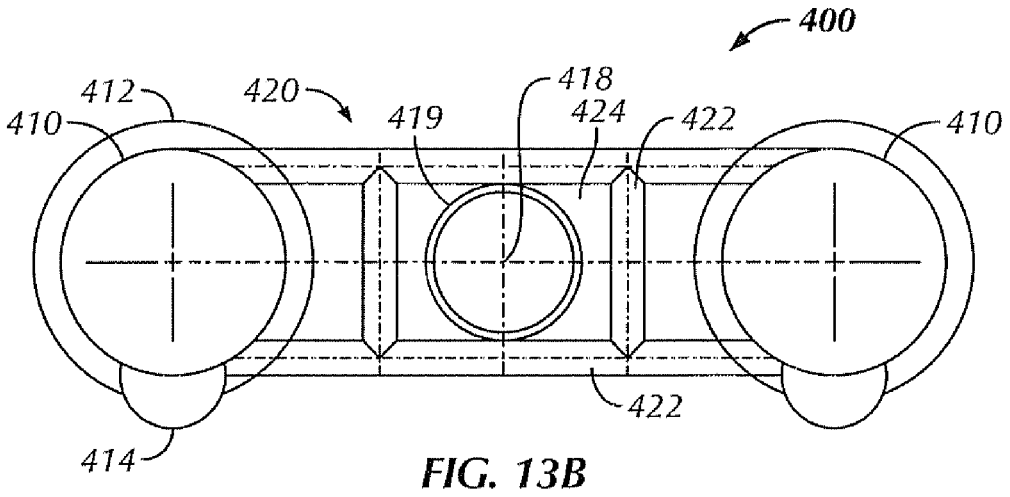
FIG. 13B shows a cross-sectional view a carrier in accordance with embodiments of the present disclosure.
Figure 13C:
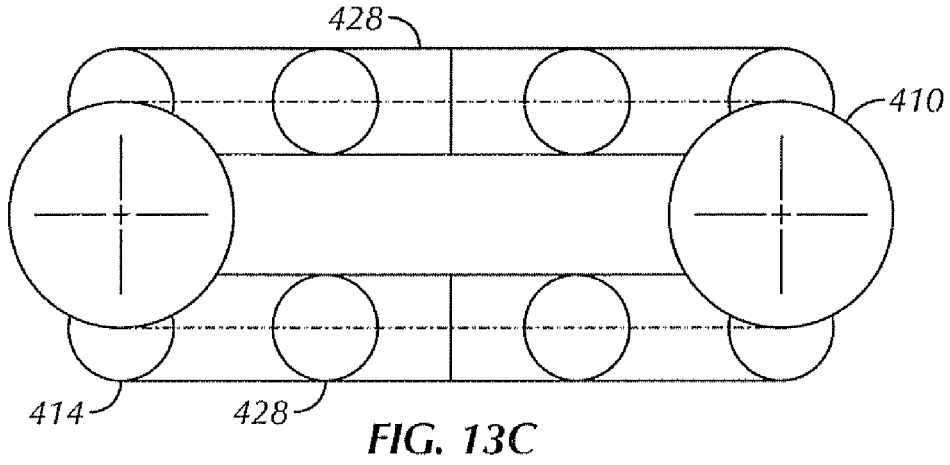
FIG. 13C shows a cross-sectional view a carrier in accordance with embodiments of the present disclosure.

Referring now to FIGS. 13A-13C, multiple views of a carrier 400 in accordance with embodiments of the present disclosure are shown. Similar to the carrier 300 of above, the carrier 400 includes floatation devices 410, such as pontoons, and structural frames 420 that are coupled together. The structural frames 420 and the floatation devices 410 include an opening or axial bore 418 therethrough that allows the sub-sea equipment 170 to be received and released from the carrier 400. Further, the floatation devices 410 provide the required buoyancy force to move the carrier 400 along with the sub-sea equipment 170 during the retrieval and deployment operations, in addition to providing structural continuity for the carrier 400.

Referring now to FIG. 13B, a cross-sectional view of the carrier 400 in accordance with embodiments of the present disclosure is shown. The carrier 400 includes floatation devices 410, in which the floatation devices 410 are connected to each other using the structural frame 420. The structural frame 420 includes support members 422, in which the support members 422 form an opening 424 within the support frame 420, which allows the sub-sea equipment 170 to be received by the carrier 400. Further, an equipment receiving member 419, such as a tubular member, may also be positioned within the support frame 420. This equipment receiving member 419 may facilitate disposing the sub-sea equipment 170 within the carrier 400, in addition to providing protection for the sub-sea equipment 170 while within the carrier 400. One of ordinary skill in the art will appreciate that the opening 424 and the equipment receiving member 419 may vary in size depending upon the type of sub-sea equipment 170 being handled by the carrier 400. Additionally, one of ordinary skill in the art will appreciate that the structural frame 420 may be buoyant, partially buoyant, or non-buoyant.

Further, the floatation devices 410 may include a buoyant material disposed therein, and the floatation devices 410 may include stiffeners 412, such as ring stiffeners, and/or floatation members 414, such as sponsons. The stiffeners 412 may be disposed about the floatation devices 410 in various locations to increase the structural rigidity of the floatation devices. The floatation members 414 may be attached to the floatation devices 410 to increase or adjust the buoyancy of the floatation devices 410 as desired and/or necessary.

Referring now to FIG. 13C, another cross-sectional view of the carrier 400 in accordance with embodiments of the present disclosure is shown. In addition to the support members 422, the carrier 400 may further include truss members 428. As shown, the truss members 428 may be attached to the floatation devices 410. These support members 428 are positioned such that they form a truss, thereby increasing the structural integrity and reducing the weight of the structural frame 420 and the carrier 400.

Additionally, the carrier 400 may include connections 416 that allow the carrier 400 to be connected and disconnected from the transport vessels 110, 111. The connections 416 may include bolts, nuts, latches or any other connection device known in the art, thereby allowing the carrier to be connected and disconnected from the transport vessels 110, 111. One skilled in the art will appreciate that the connections 416 of the carrier 400 may make the carrier 400 easier to transport, both on land and at sea, and capable of being assembled at the location of retrieval and/or deployment.

Embodiments of the present disclosure may include one or more of the following advantages. In certain embodiments, the present disclosure may provide a device (e.g., a carrier) configured to safely transfer sub-sea equipment to and from the ocean floor. In some embodiments, the present disclosure may provide at least one mechanism (e.g., locking mechanism) configured to secure the equipment to the device. Further, the present disclosure may provide a system that efficiently and cost effectively retrieves and/or deploys sub-sea equipment.

Illustrative Embodiments

In one embodiment there is disclosed a system comprising a subsea structure; and a truss comprising an opening adapted to receive the subsea structure. In some embodiments, the truss further comprises buoyancy. In some embodiments, the subsea structure comprises an electrical submersible pump. In some embodiments, the truss is modular. In some embodiments, the truss comprises a plurality of frame sections connected to a plurality of buoyancy sections. In some embodiments, the system also includes a heave compensated landing system connected to at least one of the truss and the subsea structure. In some embodiments, the system also includes a line connected to a vessel floating on a surface of a body of water at a first end of the line, and connected to at least one of the truss and the subsea structure at a second end of the line. In some embodiments, the system also includes a remotely operated vehicle adapted to assist with placing the subsea structure within the truss opening and/or removing the subsea structure from the truss opening.

In one embodiment, there is disclosed a method comprising providing a vessel floating on a surface of a body of water; connecting a line from the vessel to a subsea structure; lifting the subsea structure within the body of water; placing the subsea structure within an opening of a truss; and lifting the truss to the surface. In some embodiments, the line from the vessel to the subsea structure is connected to at least one subsea buoy to isolate the vessel's heave from the subsea structure. In some embodiments, the truss is connected to the vessel by a second line. In some embodiments, the method also includes lifting the truss and the subsea structure onto a deck of the vessel. In some embodiments, the method also includes transporting the truss and the subsea structure to land.

In one embodiment, there is disclosed a method comprising providing a vessel floating on a surface of a body of water; connecting a line from the vessel to a truss, the truss comprising an opening with a subsea structure located therein; lowering the truss and the subsea structure within the body of water; removing the subsea structure from the opening of the truss; and installing the subsea structure at desired location within the body of water. In some embodiments, the line from the vessel to the truss is connected to at least one subsea buoy to isolate the vessel's heave from the truss. In some embodiments, the subsea structure is connected to the vessel by a second line. In some embodiments, the method also includes retrieving and lifting the truss onto a deck of the vessel.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

That which is claimed is:

1. A system comprising: a subsea structure; a carrier comprising an opening adapted to receive the subsea structure; a vessel floating on a surface of a body of water; one or more buoys submerged under the surface of the body of water; a first line connecting the carrier directly to the vessel; a second line connecting the one or more buoys to the vessel; and a third line connecting the one or more buoys to the subsea structure, wherein the carrier comprises flotation devices and structural frames that are coupled together, wherein the first, second, and third lines are in use simultaneously.

2. The system of claim 1, wherein the subsea structure comprises an electrical submersible pump.

3. The system of claim 1, wherein the carrier is modular.

4. The system of claim 1, wherein the carrier comprises a plurality of frame sections connected to a plurality of buoyancy sections.

5. The system of claim 1, further comprising a remotely operated vehicle adapted to assist with placing the subsea structure within the carrier opening or removing the subsea structure from the carrier opening.

6. A method comprising: providing a vessel floating on a surface of a body of water; connecting a first line from the vessel to one or more buoys; submerging the one or more buoys that is in the body of water; connecting a second line from the one or more buoys to a subsea structure; lifting the subsea structure within the body of water; placing the subsea structure within an opening of a carrier, wherein the carrier is connected to the vessel by a third line and comprises flotation devices and structural frames that are coupled together; and lifting the carrier and the subsea structure to the surface, wherein the first, second, and third lines are in use simultaneously.

7. The method of claim 6, wherein the carrier is connected to a second vessel.

8. The method of claim 6, further comprising lifting the carrier and the subsea structure onto a deck of the vessel.

9. The method of claim 6, further comprising transporting the carrier and the subsea structure to land.

10. A method, comprising: providing a vessel floating on a surface of a body of water; connecting a first line from the vessel to a carrier, the carrier comprising an opening with a subsea structure located therein and further comprising flotation devices and structural frames that are coupled together; lowering the carrier and the subsea structure within the body of water; removing the subsea structure from the opening of the carrier by lifting it out of the carrier using a second line connected to one or more buoys, wherein the buoys are also connected via a third line to the vessel floating on the surface of the body of water; and installing the subsea structure to a desired location within the body of water, wherein the first, second, and third lines are in use simultaneously.

11. The method of claim 10, wherein the subsea structure is connected to a second vessel.

12. The method of claim 10, further comprising retrieving and lifting the carrier onto a deck of the vessel.

* * * * *